United States Patent [19]

Morris

[11] 4,403,642

[45] Sep. 13, 1983

[54] FABRIC SUPPORTING TRACK ASSEMBLY

[76] Inventor: Milton A. Morris, 21423 Stanwell St., Chatsworth, Calif. 91311

[21] Appl. No.: 327,766

[22] Filed: Dec. 7, 1981

[51] Int. Cl.[3] ..... A47H 23/01

[52] U.S. Cl. ..... 160/380; 160/328; 160/383

[58] Field of Search ..... 160/380, 392, 395, 327, 160/300, 328, 383

[56] References Cited

U.S. PATENT DOCUMENTS

| | | | |
|---|---|---|---|
| 3,848,380 | 11/1974 | Assael | 160/395 |
| 3,928,897 | 12/1975 | Tombu | 160/327 |
| 4,053,008 | 10/1977 | Baslow | 160/327 |
| 4,193,235 | 3/1980 | Cucchiara | 160/380 |
| 4,231,141 | 11/1980 | Derrick | 160/380 X |

*Primary Examiner*—Peter M. Caun
*Assistant Examiner*—Cherney S. Lieberman
*Attorney, Agent, or Firm*—Ralph B. Pastoriza

[57] ABSTRACT

The assembly comprises first and second tracks of extruded polyvinyl chloride plastic which, when interfaced, become a hinged clamp. When snapped or clamped together, the tracks tighten and securely clamp fabrics of varying weights. By providing relatively elongated tracks, the installation of the fabric is greatly facilitated in that extended marginal edges of the fabric can be clamped in a single clamping motion. There is no need for a special tool requiring successive stuffing of the fabric into a biased slot and the labor and time involved therewith.

3 Claims, 4 Drawing Figures

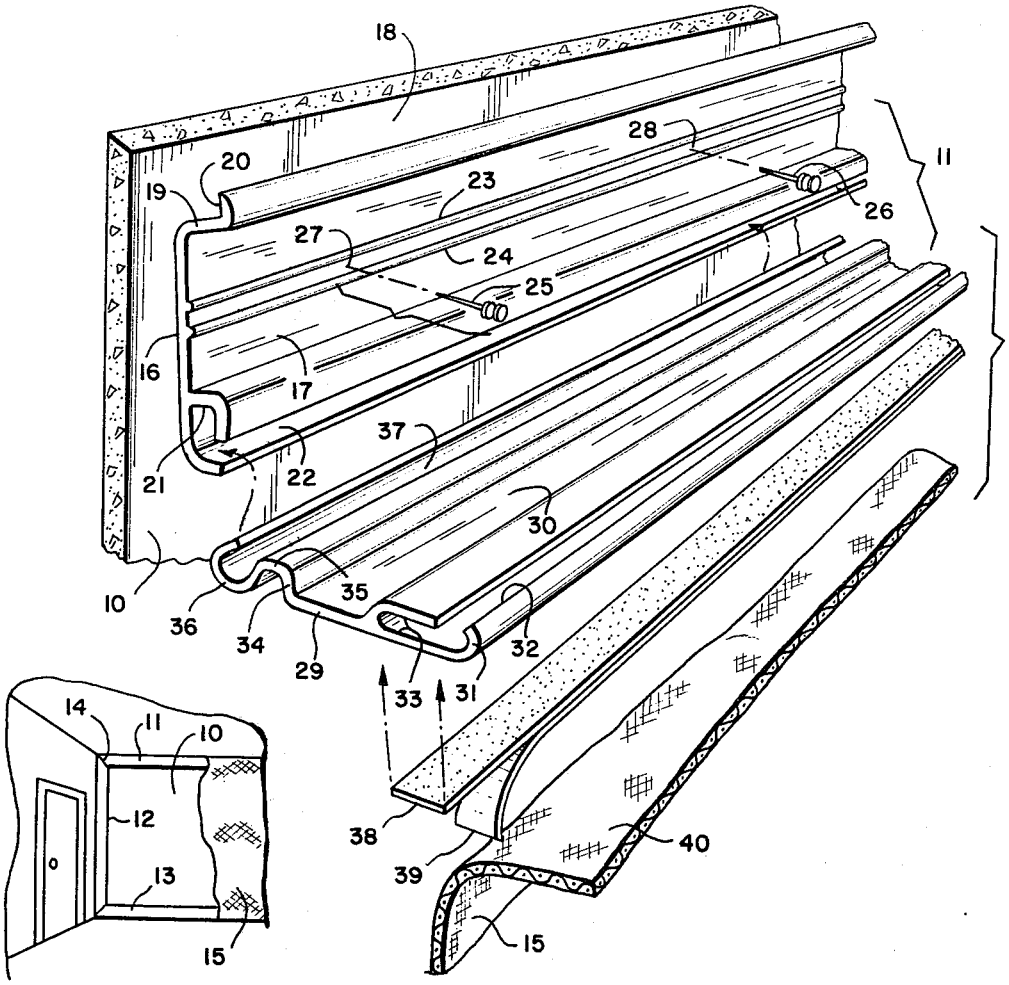
FIG. 1
FIG. 2
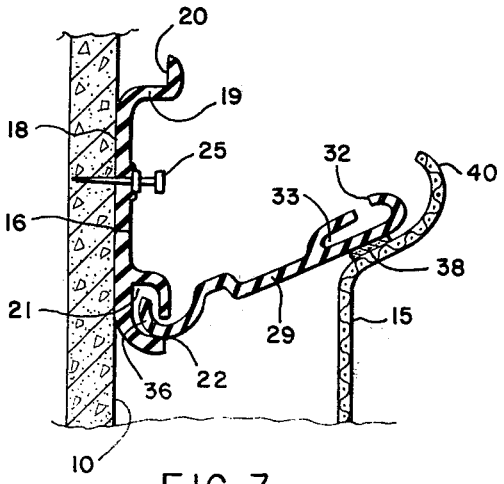
FIG. 3
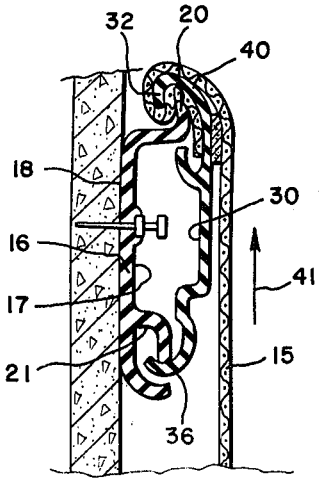
FIG. 4

FABRIC SUPPORTING TRACK ASSEMBLY

FIELD OF THE INVENTION

This invention relates generally to wall covering and more particularly to track assemblies attachable to a wall to create a framework on which a fabric material may be mounted thereby making it possible to cover the surface of a wall without the need to prepare the surface or to adhere the fabric directly to the surface.

BACKGROUND OF THE INVENTION

It is known to provide a framework formed of plastic channeling fastened by means of staples or other means onto the marginal areas of an interior wall to be covered with a fabric. Such wall, which may be formed of unfinished sheet rock, plaster, cinder block, concrete or wood, requires no preparation other than the installation of the channeling. The fabric material to be applied to the framework is first cut to the exact dimensions required, taking into account that the fabric sheet is to be subjected to tension in the framework. The margins of the fabric sheet may be glued to male chips or stiff members which are turned 180° and slotted into female channels in the framework. The installation procedure is such as to tension the fabric from top to bottom, thereby imparting to the fabric wallcovering a naturally smooth finish.

U.S. Pat. Nos. 4,018,260; 4,053,008; and 4,151,762 all are concerned with improved border pieces or channel members for providing a fabric supporting framework. The specific framework assembly disclosed in these patents is such as to make it practical for a do-it-yourselfer to attach the selvage of a fabric sheet thereto by means of simple tools. Thus, no special skills are required and there results a savings in that professional help need not be summoned.

BRIEF DESCRIPTION OF THE PRESENT INVENTION

With the foregoing in mind, the present invention contemplates the provision of fabric supporting frame means in the form of a track assembly constituting a further improvement over border pieces or channels presently available, primarily in that the securing of the selvage of the fabric can be carried out far more rapidly and with superior results.

More particularly, the fabric supporting track assembly of the present invention in its broadest concept includes a first elongated track having half snapping clamp means along one longitudinal edge and half hinge means along its opposite longitudinal edge. Means are provided for securing this first track to a marginal surface of a wall area to be covered with fabric. A second elongated track is provided having half snapping clamp means along one longitudinal edge for cooperative clamping engagement with the first mentioned half snapping clamp means and half hinge means along its opposite longitudinal edge for hinging engagement with the first mentioned half hinge means.

With the foregoing arrangement, the first track can be easily secured to the marginal surface of the wall area and the selvage of fabric material over a length corresponding to the length of the tracks received between the one longitudinal edges of the tracks when the tracks are swung open about the hinge means. Thereafter, the tracks can be swung together about the hinge means to effect a simultaneously stretching and clamping of the selvage in the tracks in a single motion or action.

A primary advantage of this invention thus resides in the ability of an installer to very rapidly "frame" the fabric without the need of special tools for "stuffing" the fabric in any type of "resilient slot". In other words, the hinge arrangement of the elongated tracks provides for the stuffing and clamping automatically when the tracks are hinged together to a clamped closed position. This action is clearly considerably faster than the successive steps of stuffing short sections of the fabric throughout the length of the channels being used by a special tool.

BRIEF DESCRIPTION OF THE DRAWINGS

A better understanding of this invention will be had by now referring to the accompanying drawings in which:

FIG. 1 is a fragmentary perspective view of a typical room wherein one wall is to be covered with fabric utilizing the fabric supporting track assembly of the present invention;

FIG. 2 is a greatly enlarged fragmentary exploded perspective view of the basic components of the track assembly further illustrating a selvage of a fabric to be secured;

FIG. 3 is a fragmentary cross section of the assembled track components of FIG. 2 during an initial stage of installation of the fabric; and FIG. 4 is a view similar to FIG. 3 but illustrating the track components in their finalized clamped position for stretching and clamping the fabric.

DETAILED DESCRIPTION OF THE PREFERRED EMBODIMENT

Referring first to FIG. 1 there is shown a residential room having a wall area 10 to be covered by a fabric in accord with the present invention. Towards this end, the fabric supporting track assembly of this invention includes an upper track assembly 11 extending across the top of the wall area 10. Also illustrated is a vertical track assembly 12 running from the top corner of the wall 10 to the bottom corner and finally a lower horizontal track assembly 13 extending along the bottom marginal edge of the wall 10. It will be understood that a fourth vertical track assembly similar to that shown at 12 is provided on the opposite corner of the room.

At the various corners where the horizontal and vertical tracks meet, the tracks themselves are mitered at 45° such as indicated at 14 for the track assemblies 11 and 12.

In FIG. 1, there is shown partly broken away the fabric covering 15 supported by the framework made up of the track assemblies.

Referring now to the enlarged exploded perspective view of FIG. 2, there are illustrated components making up the top horizontal track assembly indicated at 11 in FIG. 1. These components include a first extruded track 16 preferably of polyvinyl chloride plastic material. Track 16 has a flat longitudinal central portion 17 for engaging a flat marginal surface 18 of the wall area 10 to be covered with fabric.

One longitudinal edge of this first track which, in the case of the upper track, constitutes the upper edge, turns away from the wall area in a normal direction thereto as indicated at 19 and thence turns outwardly of the central portion 17 in a direction generally parallel to the wall area as indicated at 20 to define one half of a snapping clamp.

The opposite or lower longitudinal edge of the first track 16, in turn is formed into a C-shaped channel 21 opening away from the wall area as indicated at 22 to define one half of a hinge.

Referring again to the central portion 17 of the first track 16, the exposed surface includes longitudinally extending spaced parallel scribe lines 23 and 24 defining a mid position on the track. Means for fastening the track to the flat marginal surface 18 of the wall in the specific embodiment shown comprise duplex type nails such as indicated at 25 and 26 receivable at longitudinally spaced points such as 27 and 28 between the scribe lines 23 and 24.

By using the duplex type nails, they can be easily removed without damaging the track structure, should such be necessary. The scribe lines 23 and 24 merely facilitate proper positioning of the nails at an appropriate mid point between the opposite longitudinal edges of the track.

Referring now to the central portion of FIG. 2, there is shown a second extruded track 29 having a flat longitudinal central portion 30 for positioning in opposed spaced relationship to the first mentioned flat longitudinal central portion 17 of the first track when assembled thereon, all as will become clearer as the description proceeds.

One longitudinal edge of this second track turns towards the wall area when assembled in opposing relationship to the first track as indicated at 31 and thence inwardly as indicated at 32 to define the second half of the referred to snapping clamp. This one longitudinal edge further includes a U-shape stuffing channel as indicated at 33, the opening of the U facing the underside of the said second half of the snapping clamp made up of the formed portions 31 and 32.

The opposite longitudinal edge of the second track turns towards the wall area when the second track is in opposing relationship to the first track as indicated at 34 and thence extends outwardly of the central portion as indicated at 35. Thereafter, this opposite longitudinal edge is formed into a C-shaped channel 36 opening towards the wall as indicated at 37 to define a second half of the referred to hinge.

Referring now to the lower right-hand portion of FIG. 2, there is shown in exploded view an adhesive strip means 38 arranged to extend longitudinally along the exposed outer surface of the second track for temporarily holding the fabric 15 adjacent to its selvage. A cover strip 39 for the adhesive material is provided and may be manually peeled off to expose the adhesive strip means 38 when making an installation. The selvage of the fabric 15 is illustrated at 40 in FIG. 2.

The manner in which the first and second tracks cooperate to greatly facilitate the stretching and securing of the fabric 15 will now be evident by referring to FIGS. 3 and 4.

Referring first to FIG. 3, the first track 16 is shown installed against the flat marginal surface 18 of the wall 10, the duplex nails one of which is shown at 25 being used for this purpose.

After securement of this first extruded track, the second track 29 is hinged to the first track by interdigitating the second half of the hinge 36 with the first half of the hinge 21 as illustrated in FIG. 3. The second track is then swingable about the hinge away from the wall area to facilitate insertion of the selvage 40 of the fabric material 15 over the one longitudinal edge of the second track into the stuffing channel 33. In this respect, it will be understood that the fabric 15 can be conveniently supported adjacent to its selvage 40 as by the adhesive strip 38 as shown in FIG. 3. The selvage 40 of the fabric is in a free position preparatory to being easily manually positioned in the stuffing channel 33 after passing over the one longitudinal half clamp portion 32.

After the fabric has been received in the stuffing channel 33 the entire second track is swung by a single action into opposing relationship with the first track 16. This movement causes the second half of the snapping clamp 32 to snap over the first half 20 of this clamp effectively simultaneously stretching and locking the fabric to the first track along its entire one longitudinal edge. It will be understood that the stretching results when the one edge of the fabric opposite the selvage 40 is held fast.

The foregoing stretching is indicated by the arrow 41 in FIG. 4 and the secure clamping of the selvage 40 will be evident. Further, the spacing of the flat longitudinal central portions 17 and 30 is sufficient to accommodate the exterior heads of the duplex type nails after the tracks are snapped together.

The vertical tracks, such as the track assembly 12 and the lower horizontal tracks, such as the track assembly 13 shown in FIG. 1 are identical to the tracks described in FIG. 2, the hinged portions being always on the inside edge of the frame so that the vertical and lower horizontal portions of the fabric will be properly stretched and clamped.

It will be appreciated that the track assemblies can be provided in given lengths so that the first tracks can simply be serially secured in alignment over the top and bottom margins of a wall area to be covered, regardless of the overall length of the room. A last section, of course, could be cut on the job to neatly result in proper fitting to the overall length of the wall.

Similarly, appropriate segments can be serially connected in a vertical line along the marginal edge of the wall between the floor and the ceiling. As mentioned, the corner pieces are mitered as indicated at 14 in FIG. 1.

Since the selvage of the fabric is received in the stuffing channel, tolerances as to the overall dimensions of the fabric itself are not critical. More or less of the selvage can be received in the stuffing channel and thus professional skill in installation with respect to fabric dimensions is not required.

Finally, because of the one swinging action of the second track into clamping engagement with the first track, the tedious procedure of successive stuffing of the selvage of the fabric along appropriate channels is avoided as well as the need for any special type of tool to effect such stuffing. It can be appreciated that when the second channel is swung downwardly on the hinge as illustrated in FIG. 3, the fabric selvage is relatively loose and can be manually passed around the one longitudinal edge 32 into the stuffing channel 33 very easily and quickly. It is the upward swinging of the second track into opposed clamping engagement with the first track that will effect the necessary stretching to provide a smooth finish surface and also assure adequate securement of the fabric selvage.

From all of the foregoing, it will now be evident that the present invention has provided a greatly improved fabric supporting track assembly for covering of walls with fabric material.

I claim:

1. A fabric supporting track assembly including, in combination:

(a) a first extruded track having a flat longitudinal central portion for engaging a flat marginal surface of a wall area to be covered with fabric, one longitudinal edge of said first track turning away from the wall area in a direction generally normal thereto and thence turning outwardly of the central portion in a direction generally parallel to the wall area to define a first half of a snapping clamp, the opposite longitudinal edge of the track being formed into a C-shaped channel opening away from the wall area to define a first half of a hinge;

(b) fastening means for securing said flat longitudinal central portion to said flat marginal surface of said wall area; and, (c) a second extruded track having a flat longitudinal central portion for positioning in opposed spaced relationship to said first mentioned flat longitudinal central portion, one longitudinal edge of said second track turning towards said wall area and thence inwardly to define a second half of said snapping clamp, said one longitudinal edge further including a U-shaped stuffing channel with the opening of the U facing the underside of said second half of said snapping clamp, the opposite longitudinal edge of said second track turning towards said wall area, thence extending outwardly of the central portion, thence being formed into a C-shaped channel opening towards the wall area to define a second half of said hinge, whereby after securement of said first extruded track to said flat marginal surface of said wall area, said second track can be hinged to the first track by interdigitating the second half of said hinge with the first half of said hinge, said second track then being swingable about the hinge away from the wall area to facilitate insertion of the selvage of fabric material over said one longitudinal edge of said second track into said stuffing channel, subsequent swinging of the second track into opposing relationship to the first track a distance such that said second half of said snapping clamp snaps over said first half of said snapping clamp, to secure the selvage between the second and first snapping clamps, simultaneously stretching and locking the fabric to the first track along the entire one longitudinal edge of the first track said stretching occurring when the one edge of said fabric opposite said selvage is held fast.

2. An assembly according to claim 1, in which the exposed surface of said flat central portion of said first track includes longitudinally extending spaced parallel scribe lines defining mid positions on the track, said fastening means including duplex type nails receivable at longitudinally spaced points between the scribe lines for securing said first track to said flat marginal surface of said wall area, the spacing of said flat longitudinal central portion of said second track in opposed relationship to said first track being sufficient to accommodate the exterior heads of the duplex type nails after the tracks are snapped together.

3. An assembly according to claim 1, including adhesive strip means extending longitudinally along the exposed outer surface of the second track for temporarily holding the fabric adjacent to its selvage while inserting the selvage in said stuffing channel, and a cover strip for said adhesive strip means which can be manually peeled off to expose the adhesive strip means.

* * * * *